United States Patent [19]

Ropp et al.

[11] 4,022,228

[45] May 10, 1977

[54] NAIL POLISH REMOVER DEVICE

[76] Inventors: John G. Ropp, 140 Runnymede Road, West Caldwell, N.J. 07006; Steven A. Mann, 749 N. Broad St., Elizabeth, N.J. 07082

[22] Filed: Mar. 12, 1975

[21] Appl. No.: 557,454

[52] U.S. Cl. ..... 132/75; 15/104.92

[51] Int. Cl.[2] ..... A45D 29/17; A46B 11/00

[58] Field of Search ..... 15/21 A, 104.92, 167 B; 132/73, 74.5, 75; 211/181; 401/11

[56] References Cited

UNITED STATES PATENTS

| | | | |
|---|---|---|---|
| 88,911 | 4/1869 | Searles | 211/181 X |
| 1,962,854 | 6/1934 | Anderson | 15/206 |
| 2,524,681 | 10/1950 | Roosa | 132/75 |
| 2,703,422 | 3/1955 | Roosa | 132/75 |
| 2,771,621 | 11/1956 | Erickson | 15/167 B X |
| 2,961,682 | 11/1960 | Wurmbock et al. | 401/11 X |
| 3,281,881 | 11/1966 | Yetter | 15/104.92 X |
| 3,316,922 | 5/1967 | Seidler | 132/75 |
| 3,583,018 | 6/1971 | Fink | 15/104.92 |
| 3,800,958 | 4/1974 | Dorn | 211/181 X |

*Primary Examiner*—Daniel Blum
*Attorney, Agent, or Firm*—Robert E. Burns; Emmanuel J. Lobato; Bruce L. Adams

[57] ABSTRACT

A device for removing nail polish and other fingernail coatings comprises a container having an access opening at the top thereof and which contains therein a solvent capable of dissolving the nail polish. A brush having relatively hard, stiff bristles is mounted within the container in such a manner so as to partially surround the access opening. The brush is arranged so that the bristles engage with the fingernail when the fingertip is inserted through the access opening and the brush functions to scrub and clean the fingernail so as to remove the nail polish therefrom in response to slight movements of the fingertip. The container is composed of opaque plastic material to avoid breakage, minimize weight, and prevent the user from seeing the unsightly nail polish which dissolves in and discolors the solvent. The brush is mounted on a wire support member which has sufficient resiliency to bias and maintain the brush in its working position and the two ends of the wire which abut against the container plastic container.

6 Claims, 4 Drawing Figures

NAIL POLISH REMOVER DEVICE

BACKGROUND OF THE INVENTION

The present invention relates generally to manicuring devices for removing nail polish and other coatings from fingernails.

There are currently numerous techniques available for effecting removal of nail polish, lacquers and other nail coatings from a person's fingernails. All the techniques employ a suitable solvent capable of dissolving the nail coating and various methods have been devised for applying the solvent to the fingernails. The most common method is to simply apply the solvent to a piece of cloth or cotton which is then rubbed over the fingernails to remove the coating. This approach is disadvantageous for several reasons. One disadvantage is that the cloth or cotton is unable to effectively penetrate and clean the cuticle area of the fingernail. Another disadvantage is that the application of the solvent to the wiping cloth or cotton frequently results in spilling and splattering of the solvent onto the user's clothing or adjacent furnishings and the operation itself is quite messy. Moreover, the removal of fingernail coatings by this technique is a relatively time-consuming operation.

In order to avoid the foregoing drawbacks, various devices have been devised to assist in applying the solvent to the fingernails. To date, however, these devices have not proven satisfactory and there is still a need in the art for a simple and inexpensive device for removing fingernail coatings.

SUMMARY OF THE INVENTION

It is therefore a principal object of the present invention to provide a device for removing fingernail polish and other coatings from a person's fingernails and which overcomes the drawbacks and disadvantages enumberated above.

It is another object of the present invention to provide a device for removing fingernail polish and other fingernail coatings and which is composed of a lightweight, nonbreakable plastic to facilitate shipping and handling of the device and to reduce breakage.

It is yet another object of the present invention to provide a device for removing fingernail polish and other fingernail coatings and which is composed of opaque material so as to conceal the dissolved nail polish which accumulates and discolors the solvent during use of the device.

A further object of the invention is to provide a device for removing fingernail polish and other fingernail coatings and which employs rubbing means for rubbing solvent on the fingernails and a resilient support member resiliently supporting the rubbing means in place.

A still further object of the present invention is to provide a device for removing fingernail polish and other fingernail coatings and which is inexpensive to manufacture yet durable and rugged in construction and therefore has a long useful life.

The foregoing objects are realized by a container having an access opening at the top thereof dimensioned to receive therethrough a person's fingertip. Rubbing means is disposed within the container at a location beneath the access opening and partially surrounds the access opening so as to define a working area for receiving therein a fingernail to be treated. The rubbing means comprises a series of stiff, hard bristles carried by a resilient support member which is resiliently deformed and wedged into the container so as to maintain the bristles in position to contact the fingernail so that when the fingertip is moved back and forth, the bristles rub the solvent on the fingernail and effect removal of the nail polish. The container is composed of opaque plastic material so that the dissolved nail polish which accumulates in the solvent is not visible through the container. To avoid puncturing the plastic container bottom, the two end portions of the resilient support member are curved inwardly away from the junction lines of the container side walls and the bottom wall and extend generally flush with the container bottom. Protective caps may be provided over the end tips of the support member to ensure that the end tips do not puncture and work their way through the plastic bottom wall of the container.

Having in mind the above and other objects, features and advantages of the invention that will be evident from an understanding of this disclosure, the present invention comprises a nail polish remover device as illustrated in the presently preferred embodiment of the invention which is hereinafter set forth in sufficient detail to enable those persons skilled in the art to clearly understand the function, operation and advantages of it when read in conjunction with the accompanying drawings.

DESCRIPTION OF THE PREFERRED EMBODIMENT

Figure 1:
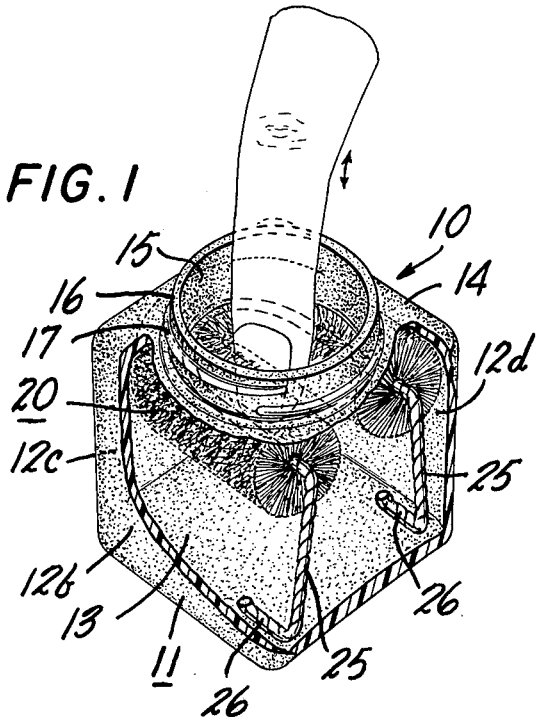
FIG. 1 is a perspective view, partly broken away, showing the nail polish remover device of the invention and the manner in which it is used.
Figure 2:
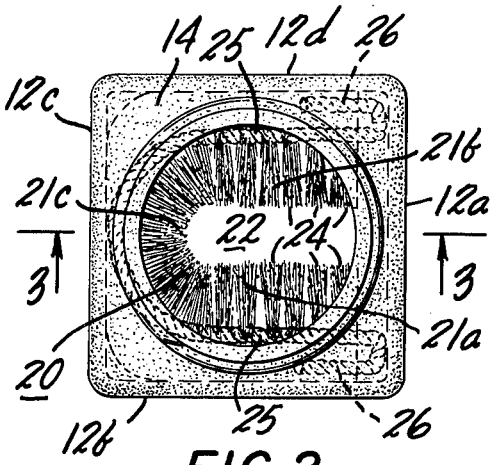
FIG. 2 is a top plan view of the nail polish remover device of the invention.
Figure 3:
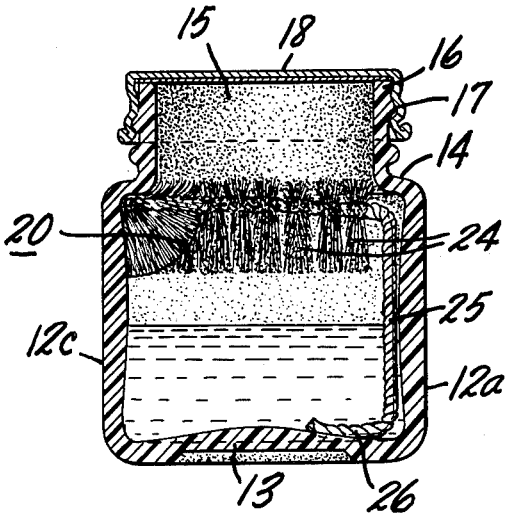
FIG. 3 is a cross-sectional view taken along the line 3—3 in FIG. 2.

As seen in FIGS. 1–3, the device 10 of the invention comprises a container 11 of generally cuboidal shape and having four side walls 12*a*, 12*b*, 12*c* and 12*d*. The base portions of the side walls are connected to a bottom wall 13 and the top portions of the side walls are connected to a top wall 14. An access opening 15 is provided in the top wall 14 and a tubular neck 16 surrounds the access opening and is connected to the top wall 14. The exterior of the neck 16 is provided with a helical thread 17 for threadedly engaging with a complementary thread in a closure cap 18.

Rubbing means 20 is disposed within the container 11 at a location immediately beneath the access opening 15. The rubbing means 20 has an elongated, curved configuration including two spaced-apart opposing sections 21*a* and 21*b* joined by an arcuate connecting section 21*c* so that the interior or center portion of the curvature defines a rubbing area 22. The rubbing width of the area 22 is dimensioned considerably smaller than the cross-sectional area or thickness of a person's fingertip so that when the fingertip is inserted into the area 22, the fingernail contacts and rubs against the rubbing means 20.

According to one aspect of the invention, the rubbing means 20 comprises an array of hard, stiff bristles 24 connected to and carried by a unique mounting means which is in the form of a resilient support member 25. The bristles 24 are arranged in tufts which are connected at spaced locations along the support member 25. The support member 25 preferably comprises at least two wire strands twisted together so as to retain therebetween the bristle tufts in a manner similar to that found in certain conventional-type bristle brushes and the details of the mounting means will be described hereinafter. The bristles preferably comprise nylon or other similar material which does not chemically react with the solvent yet which possesses sufficient stiffness and hardness to accomplish the necessary rubbing action to effect cleaning of the fingernails. As clearly seen in the drawings, the bristle tufts are densely packed along the support member 25 to ensure a large area of rubbing contact with the fingernails and the bristles 24 extend beneath and block a major portion of the access opening 15 so as to restrict entry of the fingertip through the opening to the region of the rubbing area 22.

In accordance with another aspect of the invention, the container 11 is composed of plastic material which is opaque to visible light so that the unsightly accumulation of the nail polish which dissolves in the solvent is not visible through the container walls. The container is preferably molded as a one-piece structure from suitable plastic material, for example, polypropylene. By such a construction, the container is light-weight thereby reducing shipping and handling costs and for all purposes, is unbreakable during use. The opacity of the plastic material is very important and it has been found that prior art devices of this general type have heretofore been composed of transparent glass which has proven to be entirely unsatisfactory since it makes visible the unsightly discoloring of the solvent which occurs due to the dissolving therein of the nail polish. The dissolved nail polish tends to accumulate along the container walls and such presents a very unattractive appearance. To avoid such an unsightly appearance, the container of the invention is formed of opaque plastic material so that the discoloration of the solvent is not visible through the container to the user.

According to another feature of the invention, the resilient support member 25 is uniquely shaped in relation to the shape of the container so as to maintain the bristles in their working position while preventing damage to the plastic material. The support member 25 has a body portion which is connected to and supports the rubbing means 20, two leg portions connected to opposite ends of the body portion and extending downwardly to the container bottom, and two foot portions 26 connected to respective ones of the leg portions and the foot portions 26 are bent inwardly away from the container side wall portion 12*a*. By such a construction, the bottom wall 13 and the top wall 14 of the container function as bearing surfaces for the resilient support member which is resiliently compressed and wedged between these surfaces, as best seen in FIGS. 1 and 3. The resiliency of the support member 25 is sufficient so that once the rubbing means 20 is inserted into the container, the spring action of the resilient support member effectively maintains the rubbing means in place. Moreover, the bristles 24 which are located adjacent the side and top walls are effectively wedged against these walls thereby assisting in maintaining the assembly in place.

The two foot portions 26 extend generally parallel to the bottom wall 13 and lie flush therewith. In this manner, the relatively sharp end tips of the support member 25 are kept away from the bottom wall 13 thereby preventing damage to the plastic container. It can be appreciated that absent the foot portions 26, the end tips of the support member 25 would press directly into the plastic material at the junction of the side and bottom walls and after repeated use of the device, the end tips would tend to work their way through the plastic material and puncture the same thereby permanently ruining the device and causing leakage of the solvent. To further ensure that the end tips avoid contacting the bottom wall 13, the endmost portions of the foot portions are upturned away from the bottom wall. The foot portions 26 thus perform the dual function of avoiding rupture of the plastic material and assisting in resiliently biasing and maintaining the rubbing means 20 immovably positioned within the container.

Figure 4:
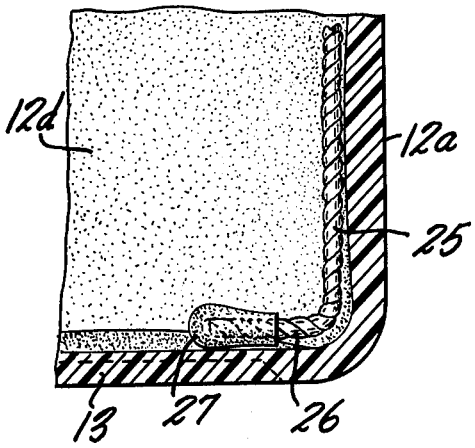
FIG. 4 is an enlarged sectional view showing a modified form of the nail polish remover device employing protective caps.

FIG. 4 shows a modified form of the support member 25 and in this modification, both end tips of the support member are provided with a protective cap 27. The protective caps 27 may be composed of plastic, rubber or other suitable material which is chemically inert with respect to the solvent and which is disposed over the end tips of the support member 25 to prevent the tips from rubbing against and possibly puncturing through the plastic bottom wall 13.

The operation of the nail polish remover device will now be described with reference again to FIG. 1. If desired, the container 11 may first be shaken while the closure cap is on so as to thoroughly wet the rubbing means 20 with solvent. The user then removes the closure cap 18 and inserts one fingertip through the access opening 15 into the working area 22 between the opposing sections 21*a* and 21*b* of the rubbing means 20, as shown. Then by simply flicking the fingertip up and down while lightly pressing the fingernail against the rubbing means 20, the solvent is rubbed on the fingernail and dissolves the nail polish.

Since the width of the working area 22 is considerably smaller than the thickness of the finger, the mere act of inserting the fingertip into the working area causes the rubbing means 20 to rub against and apply solvent to the fingernail to remove the polish therefrom. The slightest degree of movement of the fingertip will result in a rubbing action and hence the fingertip can either be turned back and forth or moved slightly up and down or any combination of these movements to obtain complete removal of the nail polish. Moreover, due to the dense packing of the bristles 24, the cuticle area of the finger is also thoroughly rubbed and accordingly removed of polish.

The device of the invention is reusable and may be readily used by persons of all age and stature. After sufficient usage, the solvent will need replacing and this can be simply accomplished by pouring out the used solvent and replacing it with fresh solvent. When the device is not in use, the closure cap 18 is put back on to prevent evaporation and escape of the solvent. Since the container 11 is formed of plastic material, the device is unbreakable and may be easily shipped and transported both by the manufacturer and the user. As the device is not fragile, it can be packed with other cosmetic articles without fear of breakage or leakage of the solvent.

The invention has been described with respect to one preferred embodiment thereof and obvious changes and modifications thereto will become apparent to those skilled in the art and the present invention is intended to cover all such obvious modifications and changes which fall within the scope and spirit of the invention as defined by the appended claims.

What we claim is:

1. A device for removing nail polish and other nail coatings from a person's fingernails comprising: a plastic container comprised of top, bottom and side walls and having an access opening in said top wall and containing therein during use of the device a suitable nail polish solvent; rubbing means disposed at a given location within said container immediately beneath and laterally across said access opening and having an elongated, curved configuration with the interior portion of the curvature defining a rubbing area for receiving and making rubbing contact with the person's fingernail when the corresponding fingertip is inserted through said access opening and being operative in response to slight movements of the fingertip to effect removal of the nail polish from the fingernail by a rubbing action of the solvent on the fingernail; mounting means comprising a resilient support member connected to and supporting thereon said rubbing means and being resiliently wedged in said container between said top and bottom walls thereby mounting said rubbing means at said given location, said resilient support member having an elongated shape having a body portion connected to said rubbing means and extending along the top wall of said container, two leg portions connected to opposite ends of said body portion and extending downwardly along a side wall portion of said container to the bottom wall of said container, and two foot portions connected to respective ones of said leg portions and being bent inwardly away from said side wall portions such that said resilient support member is resiliently wedged between the top and bottom walls of said container said resilient support member having means for preventing the end tips of said two foot portions from puncturing the bottom wall of the plastic container; and means rendering said container opaque to visible light so that the dissolved nail polish which accumulates in the solvent is not visible through said container walls.

2. A device according to claim 1; wherein said means for preventing puncture of the plastic bottom wall comprises an upturned end tip of each foot portion, each upturned end tip being turned upwardly away from the container bottom wall so as to avoid physical contact therewith.

3. A device according to claim 1; wherein said means for preventing puncture of the plastic bottom wall comprises a protective cap disposed on the end tip of each said foot portion.

4. A device according to claim 1; wherein said means rendering said container opaque to visible light comprises composing said container of opaque plastic material so that the discolored solvent is not visible through said container.

5. A device according to claim 1; wherein said rubbing means comprises an array of bristles arranged in tufts along said support member and having sufficient stiffness to effect the necessary rubbing action to remove nail polish.

6. A device according to claim 5; wherein said rubbing means extends beneath and blocks a major portion of said access opening so as to restrict entry of the fingertip therethrough to the region of said rubbing area.

* * * * *